US007101206B2

(12) United States Patent
Chang

(10) Patent No.: US 7,101,206 B2
(45) **Date of Patent: *Sep. 5, 2006**

(54) MEMORY CARD CONNECTOR WITH SWITCH TERMINALS HAVING IMPROVED CONTACTS

(75) Inventor: Chia-Chen Chang, Hsin Chung (TW)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/869,609

(22) Filed: Jun. 16, 2004

(65) Prior Publication Data

US 2005/0003693 A1 Jan. 6, 2005

(30) Foreign Application Priority Data

Jun. 17, 2003 (TW) ..... 92211042 U

(51) Int. Cl.
*H01R 29/00* (2006.01)

(52) U.S. Cl. ..... 439/188; 200/51.09

(58) Field of Classification Search ..... 439/188, 439/157, 159, 59; 200/51.1, 51.09; 235/441, 235/492

See application file for complete search history.

(56) References Cited

U.S. PATENT DOCUMENTS 3,868,162 A * 2/1975 Ammon ..... 439/75
6,719,577 B1 * 4/2004 Nogami ..... 439/188
6,896,532 B1 * 5/2005 Chang ..... 439/188

* cited by examiner

*Primary Examiner*—Khiem Nguyen
(74) *Attorney, Agent, or Firm*—Charles S. Cohen

(57) ABSTRACT

A memory card connector includes an insulative housing having a rear terminal-mounting section and at least one side wall section extending forwardly from one end of the rear section defining a card-receiving space therebetween. A first conductive terminal is mounted on the housing and has a first contact portion with a first protrusion thereon. A second conductive terminal is mounted on the housing and has a second contact portion with a second protrusion thereon. The contact portions of the terminals are normally spaced from each other but are juxtaposed so that the contact portions and the protrusions are mutually engaged in response to a memory card inserted into the card-receiving space. The protrusions are offset from each other, whereby the first protrusion of the first terminal engages the second contact portion of the second terminal, and the second protrusion of the second terminal engages the first contact portion of the first terminal.

11 Claims, 6 Drawing Sheets

MEMORY CARD CONNECTOR WITH SWITCH TERMINALS HAVING IMPROVED CONTACTS

FIELD OF THE INVENTION

This invention generally relates to the art of electrical connectors and, particularly, to a memory card connector with switch terminals having improved contact interengagement.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smartphones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like.

Some memory card connectors are provided with a write-protection function by means of a pair of elastic conductive terminals forming a controlling switch. The two switch terminals are mounted at a side of the connector and have respective elastic arms arranged in close proximity to each other and may be moved into mutual engagement by the memory card to close the controlling switch. Some memory card connectors also are provided with a card detector function by means of a third switch terminal which may be moved into engagement with one of the other switch terminals by a memory card, such as by a leading edge of the card. This indicates or detects that the card is fully inserted into the connector.

One of the problems with memory card connectors of the character described above is in maintaining a good positive engagement between the contact portions of the respective switch terminals. Typically, the contact portions are generally planar and establish a good positive contact engagement only if the entire mutually opposing planar surfaces of the contact portions are engaged. Unfortunately, the switch terminals have a tendency to twist and deform, which results in lessening the contact area between the contact portions which causes a higher resistance ratio. In other words, the actual contact area of the opposing contact portions is impaired and, thereby, impairs the conductivity between the two switch terminals. The present invention is directed to solving these problems.

SUMMARY OF THE INVENTION

An object, therefore, of the invention is to provide a memory card connector with improved switch terminals.

In the exemplary embodiment of the invention, the memory card connector includes an insulative housing having a rear terminal-mounting section and at least one side wall section extending forwardly from one end of the rear section defining a card-receiving space therebetween. A first conductive terminal is mounted on the housing and has a first contact portion with a first protrusion thereon. A second conductive terminal is mounted on the housing and has a second contact portion with a second protrusion thereon. The contact portions of the terminals are normally spaced from each other but are juxtaposed so that the contact portions and the protrusions are mutually engaged in response to a memory card inserted into the card-receiving space. The protrusions are offset from each other, whereby the first protrusion of the first terminal engages the second contact portion of the second terminal, and the second protrusion of the second terminal engages the first contact portion of the first terminal.

According to one aspect of the invention, the first and second terminals are mounted on the one side wall section of the housing. The contact portions of the terminals are generally planar. The protrusions of the terminals are convex to present rounded contact points toward the contact portions of the other terminals.

As disclosed herein, the terminals are stamped and formed of sheet metal material, and the protrusions are stamped into convex configurations out of the contact portions of the terminals. Each terminal includes a body portion fixed to the housing, and a contact spring arm cantilevered from the body portion, with the contact portion of the terminal being at a free end of the contact spring arm.

According to another aspect of the invention, a third conductive terminal is mounted on the housing and has a third contact portion with a protrusion thereon. The second conductive terminal has a pair of the second contact portions and a corresponding pair of the second protrusions. The second terminal comprises a common terminal, whereby the pair of second contact portions and second protrusions are respectively operatively associated with the first and third contact portions and protrusions of the first and third terminals, respectively.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
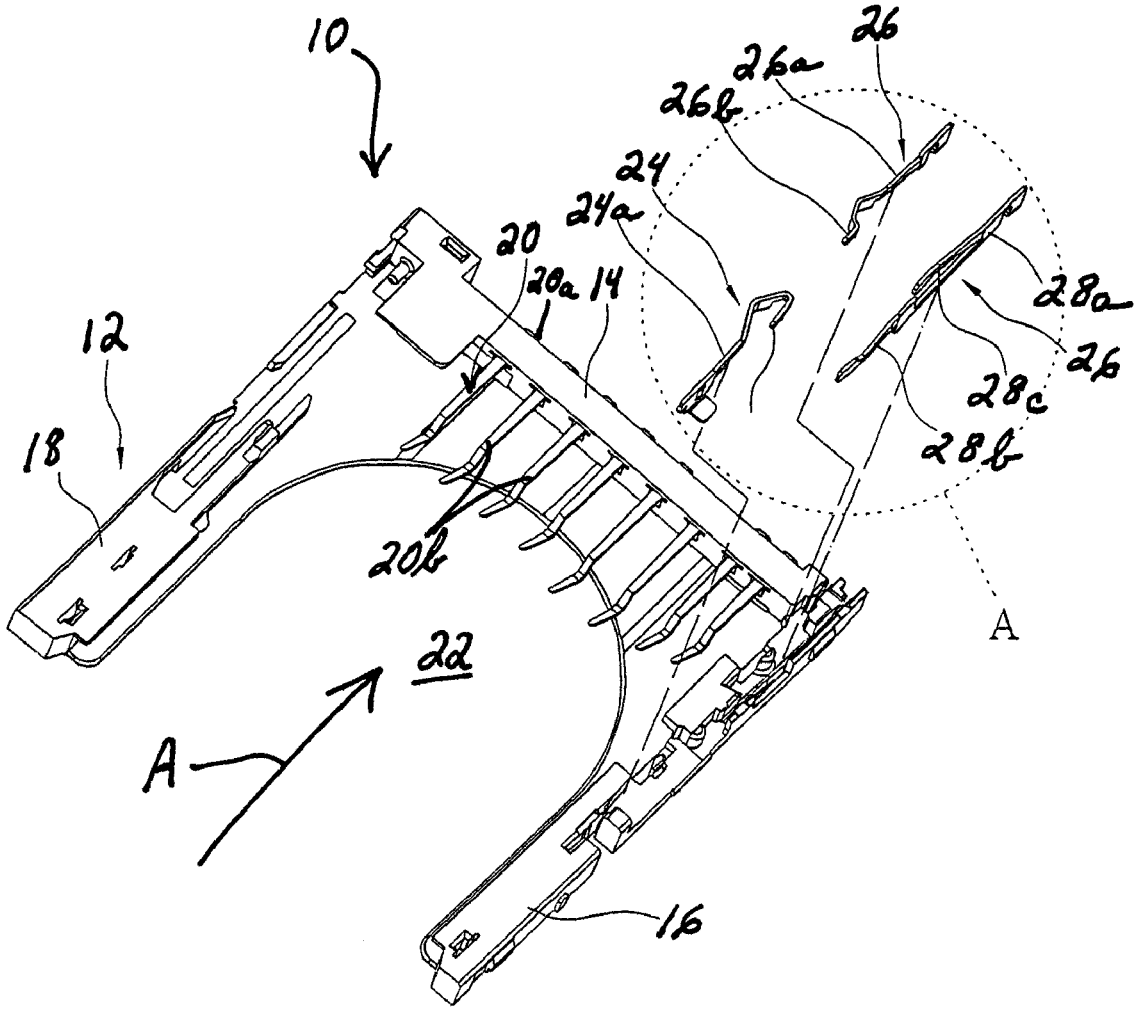
FIG. 1 is a perspective view of a memory card connector according to the invention, with the switch terminals lifted out of the housing.

Referring to the drawings in greater detail, and first to FIG. 1, the invention is embodied in a memory card connector, generally designated 10, which includes an insulative housing, generally designated 12, which has a generally U-shaped configuration. The housing includes a rear terminal-mounting section 14 and at least one side wall section 16 extending forwardly from one end of the rear section. With the U-shaped configuration, a second side wall section 18 extends forwardly from the opposite end of the rear section. However, some memory card connectors have generally L-shaped configurations, wherein a single side wall section 16 projects forwardly of the rear section.

A plurality of connector terminals, generally designated 20, are mounted through rear section 14 of the housing. The connector is adapted for mounting on a printed circuit board, and terminals 20 have tail portions 20*a* for connection, as by soldering, to appropriate circuit traces on the printed circuit board. The terminals have contact portions 20*b* projecting forwardly of rear section 14 into a card-receiving space 22 defined between side wall sections 16 and 18 and in front of rear section 14. A memory card (not shown) is inserted into the card-receiving space in the direction of arrow "A". The memory card has a contact array for engaging contact portions 20*b* of terminals 20.

As stated in the Background, above, some memory card connectors are provided with a write-protection function by means of a pair of switch terminals. Some memory card connectors are provided with a card detector function also by means of a pair of switch terminals. Connector 10 is provided with a plurality of switch terminals which effect both the write-protection function as well as the card detector function.

Figure 2:
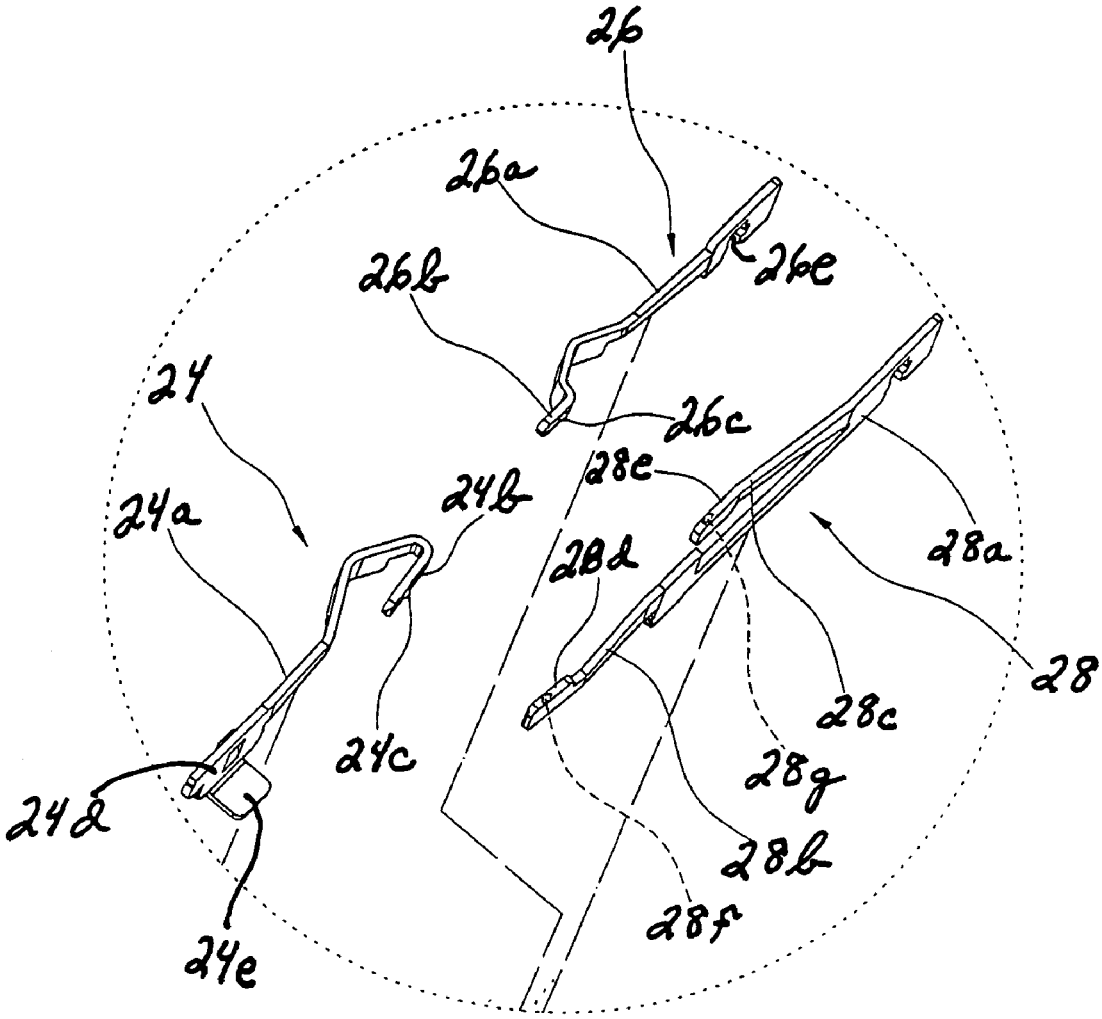
FIG. 2 is an enlarged perspective view of the area encircled at "A" in FIG. 1.

Specifically, and referring to FIG. 2 in conjunction with FIG. 1, a first switch terminal, generally designated 24, and a second switch terminal, generally designated 26, are operatively associated with a third or "common" switch terminal, generally designated 28. First switch terminal 24 has a contact spring arm 24*a* with a flat or generally planar contact portion 24*b* at a distal end of the arm, and with a rounded or convex protrusion 24*c* projecting from the contact portion. Second switch terminal 26 has a contact spring arm 26*a* with a flat or generally planar contact portion 26*b* at a distal end of the arm, and with a rounded or convex protrusion 26*c* projecting from the contact portion. As will be understood hereinafter, first switch terminal 24 effects the write-protection function of the connector, and second switch terminal 26 effects the card detector function of the connector.

The third or common switch terminal 28 is operatively associated with both the first and second switch terminals 24 and 26, respectively. The first and second switch terminals 24 and 26 have body portions 24*d* and 26*d*, respectively, for fixing the terminals in side wall section 16 of housing 12, along with feet portions 24*e* and 26*e* for connection, as by soldering, to appropriate circuit traces on the printed circuit board.

The third or common switch terminal 28 has a body portion 28*a* fixed to side wall section 16 of housing 12. A pair of contact spring arms 28*b* and 28*c* are cantilevered from the body portion in the same direction. Generally flat or planar contact portions 28*d* and 28*e* are formed as enlarged contact pads at the free ends of contact spring arms 28*b* and 28*c*, respectively. The contact portions 28*d* and 28*e* have protrusions 28*f* and 28*g* thereon. The protrusions face the contact portions of first and second switch terminals 24 and 26 as seen in FIG. 2.

All of the switch terminals 24, 26 and 28 may be stamped and formed of conductive sheet metal material. Protrusions 24*c*, 26*c*, 28*f* and 28*g* are formed by stamping the protrusions from planar contact portions 24*b*, 26*b*, 28*d* and 28*e* of the respective terminals. Therefore, it is contemplated that the protrusions are convex to present rounded contact points directed toward the contact portions of the respective other terminals.

Figure 3:
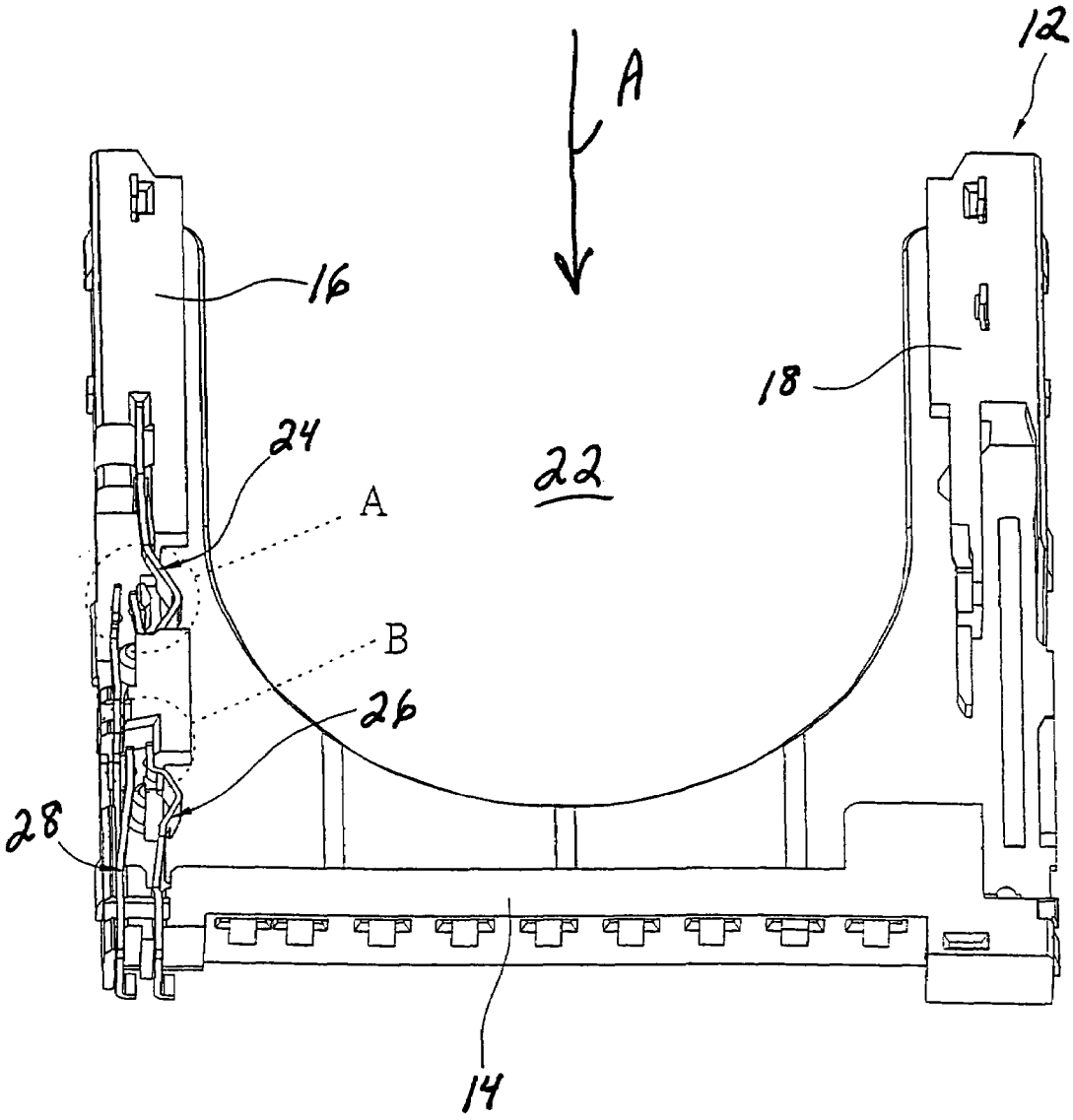
FIG. 3 is a top perspective view of the connector in assembled condition.
Figure 3A:
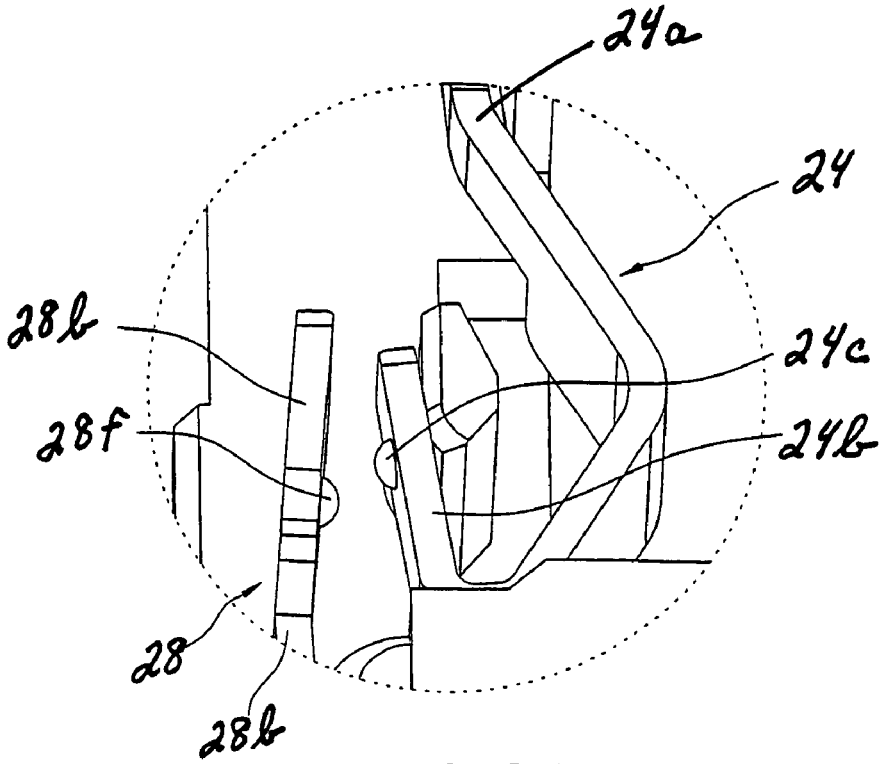
FIG. 3A is an enlarged, fragmented perspective view of the area encircled at "A" in FIG. 3.
Figure 3B:
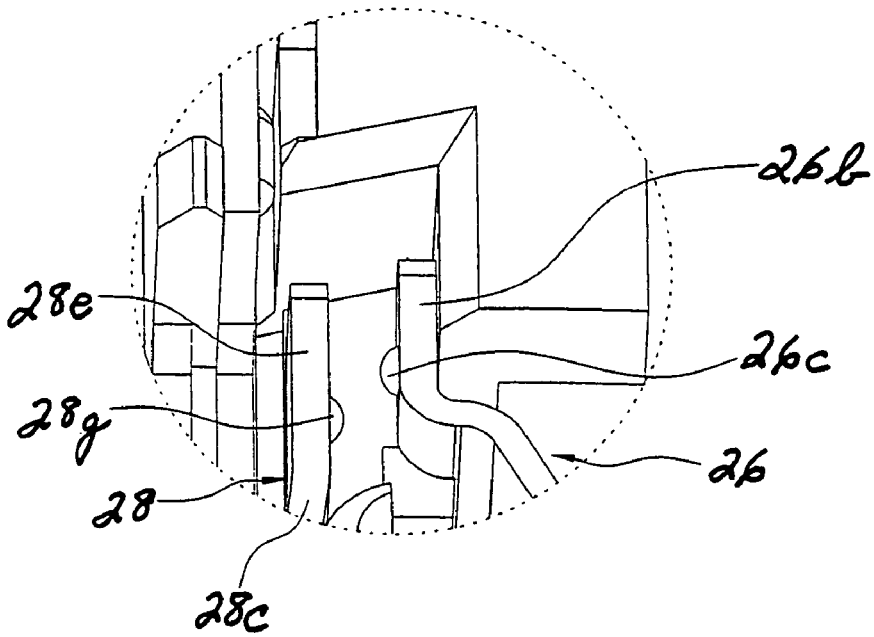
FIG. 3B is an enlarged, fragmented perspective view of the area encircled at "B" in FIG. 3.

FIG. 3 shows switch terminals 24, 26 and 28 mounted in appropriate slots in side wall section 16 of housing 12, and FIGS. 3A and 3B show the area of contact between the respective terminals. Specifically, FIG. 3A shows contact portion 24*b* of first switch terminal 24 normally spaced from but juxtaposed with contact portion 28*b* of common switch terminal 28. Protrusions 24*c* and 28*f* of the respective terminals also are normally spaced apart. Similarly, FIG. 3B shows contact portion 26*b* of second switch terminal 26 normally spaced from but juxtaposed with contact portion 28*e* of common switch terminal 28. Protrusions 26*c* and 28*g* also are spaced apart.

Figure 4:
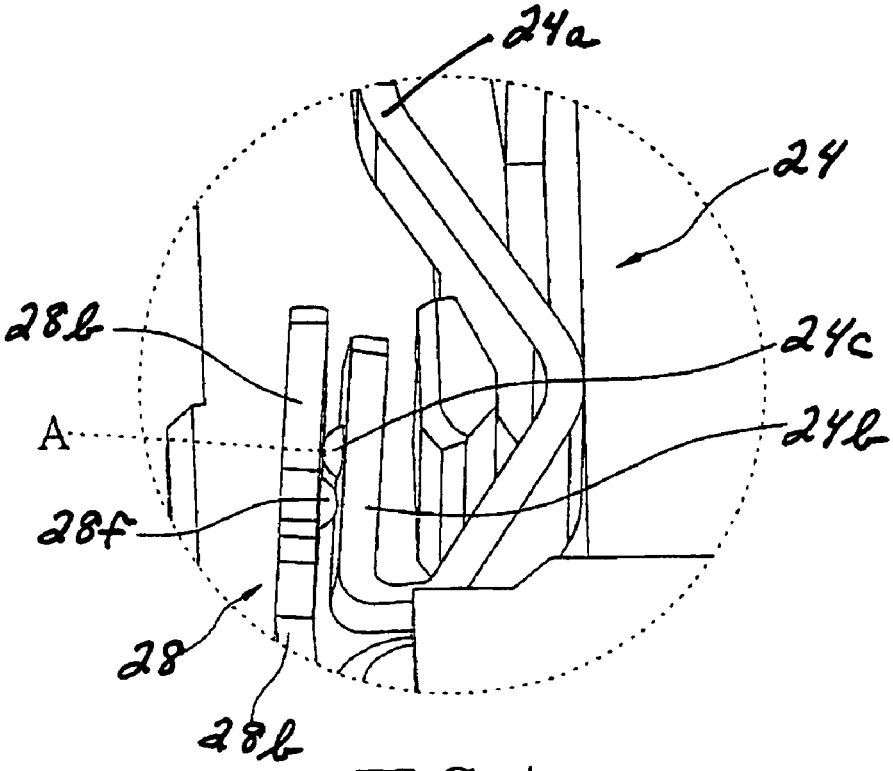
FIG. 4 is a view similar to that of FIG. 3A, but with the terminals in their interengaged state.

Referring to FIG. 4 in conjunction with both FIGS. 3A and 3B, the invention contemplates that the protrusions are offset from each other at each connection interface between the respective terminals so that the protrusion of one terminal engages the contact portion of the other terminal, rather than the protrusions engaging each other. In other words, in FIG. 4, protrusion 24*c* of first switch terminal 24 is offset from protrusion 28*f* of common terminal 28, whereby protrusion 24*c* of the first terminal engages contact portion 28*b* of the common terminal, and protrusion 28*f* of the common terminal engages contact portion 24*b* of the first terminal 24. Similarly, in FIG. 3B, protrusion 26*c* of second switch terminal 26 will engage contact portion 28*e* of common switch terminal 28, and protrusion 28*g* of the common terminal will engage contact portion 26*b* of the second terminal.

When a memory card is inserted into card-receiving space 22 in the direction of arrow "A" (FIG. 1), a side edge of the card sequentially engages contact portion 24*b* of first switch terminal 24 (FIG. 3A) and then contact portion 26*b* of second switch terminal 26 (FIG. 3B). This sequentially biases contact spring arms 24*a* and 26*a* of the first and second switch terminals, respectively, outwardly toward common switch terminal 28. In turn, the protrusions of the first and second switch terminals and the protrusions of the common switch terminal interengage as described in detail above in relation to FIG. 4. The movement of the memory card effectively actuates the write-protection function of the connector afforded by first switch terminal 24 engaging third switch terminal 28, and then effectively actuates the card detector function of the connector afforded by second switch terminal 26 engaging third switch terminal 28 as the memory card reaches its fully inserted position.

The above-described connection interengagements between the respective terminals has various advantages. First, the convex protrusions establish very positive contact points between the respective terminals. The offset protrusions provide redundant contact points to ensure that there is a good positive contact engagement between the terminals. It has been found that this engagement reduces the resistance between the terminals, and the electrical conductivity between the terminals is considerably enhanced. As a result, the memory card connector has an electrical reliability not present in the prior art.

Figure 4A:
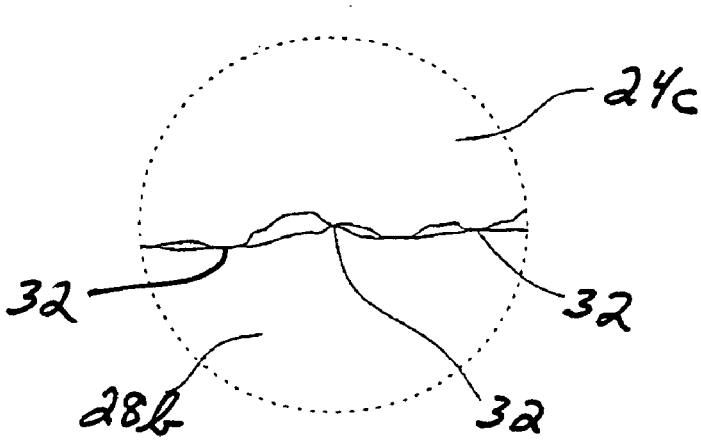
FIG. 4A is an enlarged depiction of the contact point at "A" in FIG. 4.

FIG. 4A shows that there are many minute points 32 of engagement between the protrusions of the terminals and the contact portions of the terminals. This lowers the electrical resistance between the terminals.

Figure 5:
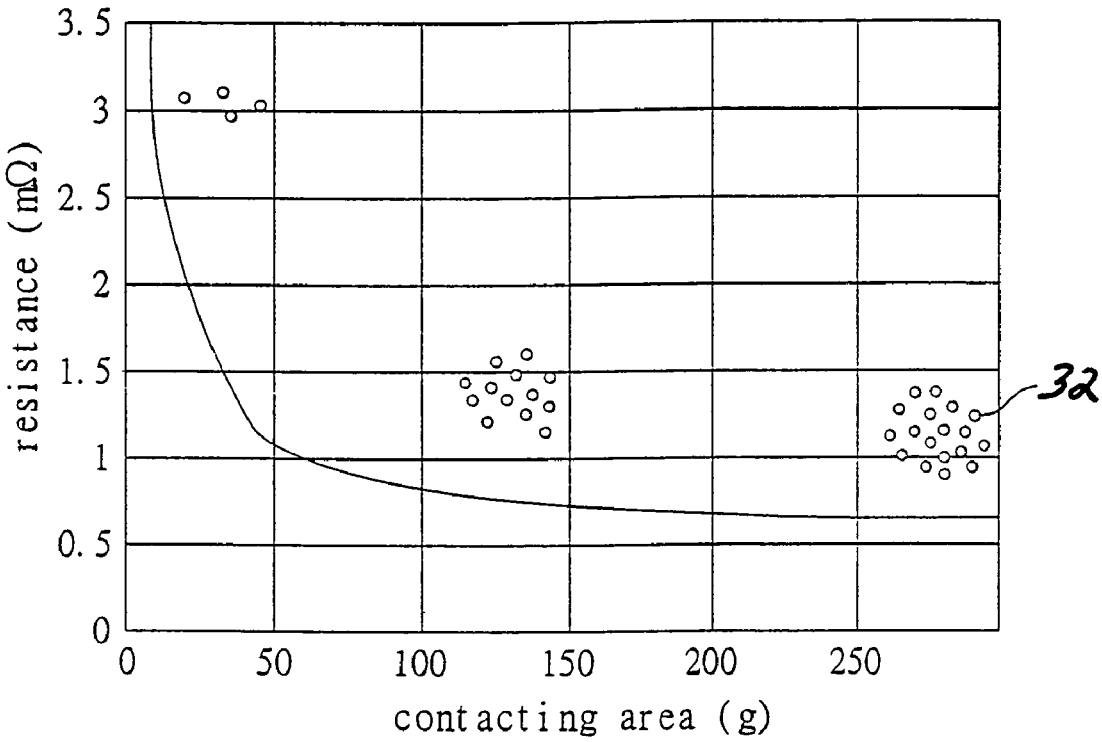
FIG. 5 is a graph showing the contact area versus resistance characteristic between the terminals of the invention.

Finally, FIG. 5 shows a graph of the contact area versus resistance characteristics between switch terminals of a memory card connector, in which the Y-coordinate represents resistance, and the X-coordinate represents contact area. It can be seen that the larger contact area produces lower resistance and, thereby, the electrical conductivity is higher. FIG. 5 also shows three sets of minute contact points 32, to emphasize that the more contact points corresponds to a larger contact area to produce lower resistance and, thereby, higher electrical conductivity.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A memory card connector, comprising:

an insulative housing having a rear terminal-mounting section and at least one side wall section extending forwardly from one end of the rear section defining a card-receiving space therewith;

a first conductive terminal mounted on the housing and having a first contact portion with a first protrusion thereon;

a second conductive terminal mounted on the housing and having a second contact portion with a second protrusion thereon;

the contact portions of said terminals being normally spaced from each other but juxtaposed so that the contact portions and the protrusions are mutually engaged in response to a memory card inserted into said card-receiving space; and said protrusions being offset from each other whereby the first protrusion of the first terminal engages the second contact portion of the second terminal, and the second protrusion of the second terminal engages the first contact portion of the first terminal.

2. The memory card connector of claim 1 wherein the contact portions of the terminals are generally planar.

3. The memory card connector of claim 1 wherein the protrusions of the terminals are convex to present rounded contact points directed toward the contact portions of the respective other terminal.

4. The memory card connector of claim 3 wherein said terminals are stamped and formed of sheet metal material, and said protrusions are stamped into convex configurations out of the contact portions of the terminals.

5. The memory card connector of claim 1 wherein at least one of said terminals includes a body portion fixed to the housing, and a contact spring arm cantilevered from the body portion, with the contact portion of the terminal being at a free end of the contact spring arm.

6. The memory card connector of claim 1, including a third conductive terminal mounted on the housing and having a third contact portion with a protrusion thereon, said second conductive terminal having a pair of said second contact portions and a corresponding pair of said second protrusions, the second terminal comprising a common terminal whereby the pair of second contact portions and second protrusions are operatively associated respectively with the first and third contact portions and protrusions of the first and third terminals, respectively.

7. The memory card connector of claim 1 wherein said first and second terminals are mounted on said one side wall section of the housing.

8. A memory card connector, comprising:

an insulative housing having a rear terminal-mounting section and at least one side wall section extending forwardly from one end of the rear section defining a card-receiving space therewith;

a first conductive terminal mounted on the one side wall section of the housing and having a first, generally planar contact portion with a first protrusion thereon, the protrusion being convex to present a rounded contact point;

a second conductive terminal mounted on the side wall section of the housing and having a second, generally planar contact portion with a second protrusion thereon, the protrusion being convex to present a rounded contact point;

the contact portions of said terminals being normally spaced from each other but juxtaposed so that the contact portions and the protrusions are mutually engaged in response to a memory card inserted into said card-receiving space; and said protrusions being offset from each other whereby the first protrusion of the first terminal engages the second contact portion of the second terminal, and the second protrusion of the second terminal engages the first contact portion of the first terminal.

9. The memory card connector of claim 8 wherein said terminals are stamped and formed of sheet metal material, and said protrusions are stamped into convex configurations out of the contact portions of the terminals.

10. The memory card connector of claim 8 wherein at least one of said terminals includes a body portion fixed to the housing, and a contact spring arm cantilevered from the body portion, with the contact portion of the terminal being at a free end of the contact spring arm.

11. The memory card connector of claim 8, including a third conductive terminal mounted on the side wall section of the housing and having a third contact portion with a protrusion thereon, said second conductive terminal having a pair of said second contact portions and a corresponding pair of said second protrusions, the second terminal comprising a common terminal whereby the pair of second contact portions and second protrusions are operatively associated respectively with the first and third contact portions and protrusions of the first and third terminals, respectively.

* * * * *